US009920504B2

(12) United States Patent
Bierwith

(10) Patent No.: US 9,920,504 B2
(45) Date of Patent: Mar. 20, 2018

(54) SELF-LOCKING CONNECTOR PIN FOR DEMOUNTABLY SECURING CONSUMABLE GROUND DIGGING COMPONENTS TO CONTAINERS OF EARTH MOVING EQUIPMENT

(71) Applicant: Robert S. Bierwith, Alameda, CA (US)

(72) Inventor: Robert S. Bierwith, Alameda, CA (US)

( * ) Notice: Subject to any disclaimer, the term of this patent is extended or adjusted under 35 U.S.C. 154(b) by 0 days.

(21) Appl. No.: 14/752,650

(22) Filed: Jun. 26, 2015

(65) Prior Publication Data

US 2015/0376872 A1 Dec. 31, 2015

Related U.S. Application Data

(60) Provisional application No. 62/018,502, filed on Jun. 27, 2014.

(51) Int. Cl.
*E02F 9/28* (2006.01)

(52) U.S. Cl.
CPC ..... *E02F 9/2891* (2013.01); *E02F 9/2841* (2013.01)

(58) Field of Classification Search
CPC ..... E02F 9/2816; E02F 9/2825; E02F 9/2833; E02F 9/2841; E02F 9/2875; E02F 9/2883; E02F 9/2891
See application file for complete search history.

(56) References Cited

U.S. PATENT DOCUMENTS 5,361,520 A 11/1994 Robinson
5,452,529 A * 9/1995 Neuenfeldt ..... E02F 9/2825 37/395
5,491,915 A * 2/1996 Robinson ..... E02F 9/2841 37/455

(Continued)

FOREIGN PATENT DOCUMENTS

WO WO 2009026650 A1 * 3/2009 ..... E02F 9/2833
WO WO 2012068643 A1 * 5/2012 ..... E02F 9/2825
WO 2014/046587 A1 3/2014

OTHER PUBLICATIONS

Invitation to Pay Additional Fees and, where applicable, protest fee, with partial search report dated Sep. 17, 2015, from International Application No. PCT/US2015/038080 (2 pages).

(Continued)

*Primary Examiner* — Robert E Pezzuto
*Assistant Examiner* — Adam J Behrens
(74) *Attorney, Agent, or Firm* — Kilpatrick Townsend & Stockton LLP

(57) ABSTRACT

A method and apparatus for installing and removing shrouds from the lips of an earth moving bucket. The lips have forwardly converging upper and lower surfaces which are engaged by correspondingly rearwardly diverging legs of the shrouds that overly and are in contact with the lip surfaces. A hole is provided in the lip and an oblong hole in one of the legs that is aligned with the hole and has axially extending, spaced-apart flat walls which define engagement ledges that face and overlap the bore. A connector for securing the shroud to the lip is placed in the bore and the hole and has shaped exterior surfaces for positioning between the walls so that the connector is axially movable along the walls and past the engagement ledges while relative rotations between the connector and the hole in the leg are prevented.

15 Claims, 6 Drawing Sheets

(56) References Cited

U.S. PATENT DOCUMENTS

| | | | | |
|---|---|---|---|---|
| 5,784,813 | A * | 7/1998 | Balassa | E02F 9/2833 37/455 |
| 5,937,550 | A * | 8/1999 | Emrich | E02F 9/2841 37/456 |
| 6,301,810 | B1 * | 10/2001 | Fidler | E02F 9/2833 37/455 |
| 6,430,851 | B1 * | 8/2002 | Clendenning | E02F 9/2825 37/457 |
| 2004/0016153 | A1 * | 1/2004 | Pippins | E02F 9/2875 37/456 |
| 2004/0071526 | A1 | 4/2004 | Lesecq | |
| 2004/0237354 | A1 * | 12/2004 | Emrich | E02F 9/2841 37/450 |
| 2008/0092413 | A1 * | 4/2008 | McClanahan | E02F 9/2883 37/451 |
| 2010/0162594 | A1 | 7/2010 | Bierwith | |
| 2013/0269223 | A1 * | 10/2013 | Knight | E02F 3/3686 37/456 |
| 2014/0082977 | A1 * | 3/2014 | Pilon | E02F 9/2833 37/453 |
| 2015/0013197 | A1 * | 1/2015 | Campomanes | E02F 9/2833 37/453 |
| 2015/0113839 | A1 * | 4/2015 | Bilal | E02F 9/2841 37/456 |
| 2016/0356023 | A1 * | 12/2016 | Ruvang | E02F 9/2841 |
| 2017/0022690 | A1 * | 1/2017 | Tasovski | E02F 9/2833 |

OTHER PUBLICATIONS

International Search Report dated Dec. 4, 2015 for International Patent Application No. PCT/US2015/038080, 6 pages.

Written Opinion dated Dec. 4, 2015 for International Patent Application No. PCT/US2015/038080, 7 pages.

* cited by examiner

SELF-LOCKING CONNECTOR PIN FOR DEMOUNTABLY SECURING CONSUMABLE GROUND DIGGING COMPONENTS TO CONTAINERS OF EARTH MOVING EQUIPMENT

CROSS-REFERENCES TO RELATED APPLICATIONS

This application claims the benefit of U.S. Provisional Application No. 62/018,502, filed on Jun. 27, 2014, which is incorporated by reference herein.

BACKGROUND OF THE INVENTION

Ground-moving, breaking and excavating equipment employs buckets, dragline buckets, shovels and other containers (hereafter collectively "buckets") with which earth, gravel, rock formation and the like are excavated and moved around. Typically, such buckets carry a lip defining their digging edges, and the lips in turn mount consumable components which need periodic replacement, such as shrouds, adapters for digging teeth, digging teeth themselves and the like (hereinafter collectively "shrouds").

The shrouds and their connections to the lips of the buckets are subject to the most wear and tear of the entire bucket because they are exposed to constant abrasion, shaking, impacts and the like encountered during ground moving operations. As a result, they require frequent replacement. Replacing shrouds in accordance with the prior art is relatively time-consuming and labor intensive because it typically requires a combination of wedges and clamp like structures which must be manually hammered into place or out of their locked positions. The excavating equipment must sit idle during that time, all of which is undesirable because it reduces profits.

SUMMARY OF THE INVENTION

The present invention is directed to the manner in which the shrouds are secured to the lips of buckets, and replaced when worn or damaged, and concerns both a method and apparatus for rapidly and efficiently installing and removing shrouds from the lips.

The lips typically have forwardly converging upper and lower surfaces which are engaged by correspondingly rearwardly diverging legs of the shrouds that overly and are in contact with the lip surfaces. In many embodiments, a hole can be formed in the lip and an oblong-hole in the legs that is aligned with the hole and has axially extending, spaced-apart flat walls which define engagement ledges that face and overlap the hole. A connector for securing the shroud to the lip can be placed in the oblong-bore and the hole and has shaped exterior surfaces for positioning between the walls so that the connector is axially movable along the walls and past the engagement ledges while relative rotations between the connector and the oblong-bore in the leg are prevented. In another embodiment the exterior of the connector pin and the hole in the lip and the bore in the shroud leg can be cylindrical.

In many embodiments, the connector can have a base for insertion into the hole in the lip and a housing that extends from the bore into the hole. The housing is split in the axial direction and defines opposing housing halves which surround the base to keep the base and the housing in axial alignment with each other. The base can have flat wall sections in alignment with the flat walls on the exterior of the housing and the housing and base are further prevented from rotationally moving relative to each other.

A first, lateral projection inside the bore can extend from the housing to an enlarged portion of the bore and laterally past the hole to limit how far the housing can move axially into the bore. A second, lateral projection can extend from the base in lateral alignment with the first projection from the hole and into a space between the first projection and the lip. Retractable locking arms can be embedded in recesses formed in surfaces of the base opposite the wall. Portions of the arms, e.g. their ends facing the bore in the housing, can be resiliently urged, laterally and outwardly, towards the walls.

The shroud can be secured to the lip by aligning the respective bore and hole and axially sliding the connector, connector base first, into the bore and from there into the hole. During this motion of the connector the outwardly biased locking arm ends are forced and retracted into the associated recesses in the base. As soon as the locking arm ends clear the engagement ledges during the downward movement of the connector pin the arm ends are automatically moved laterally and outwardly to contact the engagement ledges that overlap hole, thereby automatically locking the base and the housing to the shroud and to the lip.

In many embodiments, the housing and the base of the connector are secured to each other with an axially extending bolt that engages a threaded hole in the base. Upon tightening the bolt the housing and the base are drawn together to set an axial distance between the end of the locking arms facing the bore in the housing and the engagement ledges formed by the housing which allows minimal play between the locking arms and the engagement ledges, just sufficient to permit the arms to pivot inwardly when their free ends clear the ledges. To install the shroud on the lip the connector is simply dropped, base first, into the bore and, to the extent necessary, urged, e.g. manually pushed into the bore until the locking arms can laterally expand into engagement with the engagement ledges, which secures and locks the shroud to the lip.

Following the lateral release of the locking arms they are in lose engagement with the engagement surfaces which alone secures the connector to the lip. Moreover the bolt can be tightened to firmly press the locking arms into contact with the engagement ledges of the connector housing.

The parting lines between the components of the configured to form narrow gaps, typically in the order of no more than about 1/64" to 1/8", into which fine granular material such as fine sand or powder, for example, will migrate during operational use of the bucket. With use this granular material becomes compacted in the gaps and thereby further rigidifies the installed connector.

The shroud is securely attached to the lip with a connector pin between the top surface of the lip and the upper shroud leg that engages the top surface of the lip. The connector pin resists downward forces acting on the shroud because it acts as a rigid upright post. The shroud becomes attached to the lip because the legs of the shroud are in snug contact with the converging surfaces of the lip and the post formed by the connector pin prevents movements of the shroud relative to the lip. In some embodiments, the shroud can only be replaced by first unthreading the bolt while it is still in the hole and the bore and then individually sliding the components of the connector out of the bore and the hole.

To speed up the replacement of shrouds it is preferred to provide the bolt with a head that can be power rotated, for example with an electric drill fitted with suitable rotating implements such as screw drivers or sockets, for example.

Activation of the electric drill rapidly unthreads the bolt, releases it from the base and raises the bolt and the housing upwardly in the bore where the connector pin can be grasped, pulled out or the bore and the fresh shroud can be installed. Rotation of the bolt raises both the bolt and the housing in the bore since the base of the connector remains locked to the lip.

In this manner, a worn shroud can typically be removed in less than one minute, much less time than is needed to remove worn shrouds in accordance with past practices. This leads to significant cost savings because of the relatively large number of shrouds on industrial buckets and the frequency with which they must be replaced.

A further advantage provided by this invention is that removal of the worn shroud with an electric drill or the like automatically provides access to the bolt even when, as is frequently the case, the bolt head inside the bore in the shroud becomes embedded in hardened particulate matter, and even hardened concrete, that accumulate during operational use. In the past this required that the hardened material be tediously removed with chisels and the like.

In contrast thereto, the activated drill bit is pushed against the embedded material which causes it to shatter, thereby freeing and providing access to the bolt head so that continued activation of the electric drill will unthread the bolt from the base as earlier described.

In the other embodiment mentioned earlier, the pivoting arms are replaced by reciprocating pawls that are moved over the locking surface to secure and lock the connector pin in place.

DETAILED DESCRIPTION OF THE INVENTION

Figure 1:
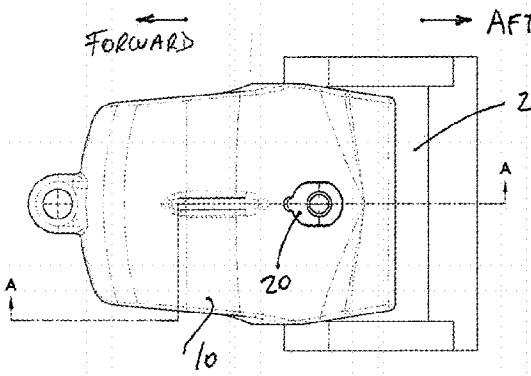
FIG. 1 is a plan view and shows a shroud demountably attached to a lip of a bucket in accordance with the invention.

Referring to FIGS. 1-6, a lip 2 of a bucket (not separately shown) of earthmoving equipment (not separately shown) has forwardly converging upper and lower surfaces 4, 6 that terminate at a forward end 8 of the lip 2. A shroud 10 (as mentioned the term also encompasses consumable components such as adapters for teeth, teeth alone and other attachment demountably secured to the lip) has rearwardly diverging legs 12 that overly and engage the lip surfaces 4, 6.

The terms "forward", "aft", "up" and "down" as used herein to simplify the description and they refer to the typically horizontal orientation of the lip during installation and removal of the shroud and connector pin.

The lip 2 has a cylindrical hole 16 that communicates with an enlarged, oblong bore 18 in at least one of the legs of the shroud 10. The hole 16 and bore 18 are vertically oriented and to secure the shroud 10 to the lip 2 all that is required that the connector pin of this invention be manually dropped into the upwardly open end of the bore and be pushed down as needed until it has arrived in its locked position as is further explained below.

Connector pin 20 has a base 22 that is principally disposed in and substantially immovable fixed to the lip 2 in lip hole 16. A housing 24 extends from bore 18 in the upper shroud leg into hole 16 in the lip 2 and a threaded bolt 26 secures the housing 24 and the base to each other.

As described in more detail below, installed base 22 is locked to the lip 2 so that it cannot move into the hole past a preset, fully inserted locked position. In that position the base cannot be moved out of the hole. As a result, the entire connector is locked and fixed to the lip as well. When the shroud needs replacement bolt 26 is backed up, that is unthreaded from the base into its released position shown in FIGS. 4 and 5.

Figure 5:
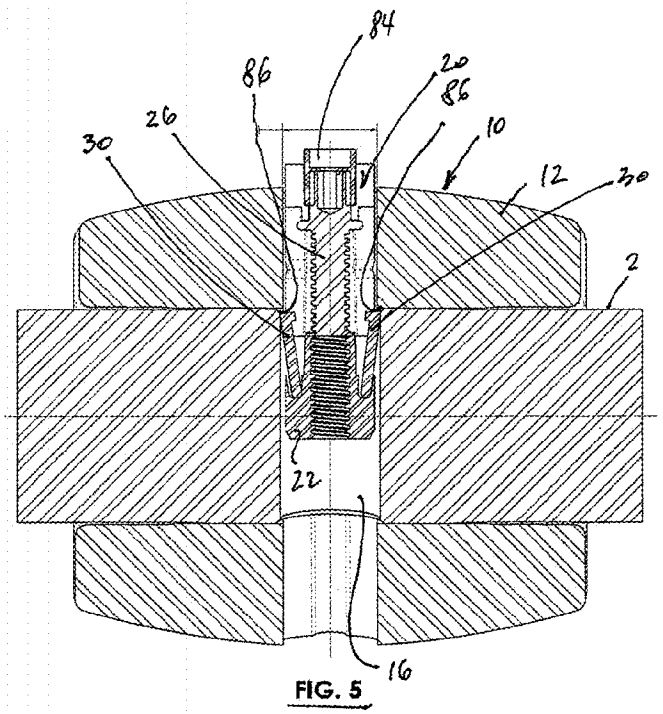
FIGS. 4 and 5 are cross-sections also taken along lines A-A and B-B of FIGS. 1 and 2, respectively, but show the connector pin in its separated condition and ready for removal.
Figure 7:
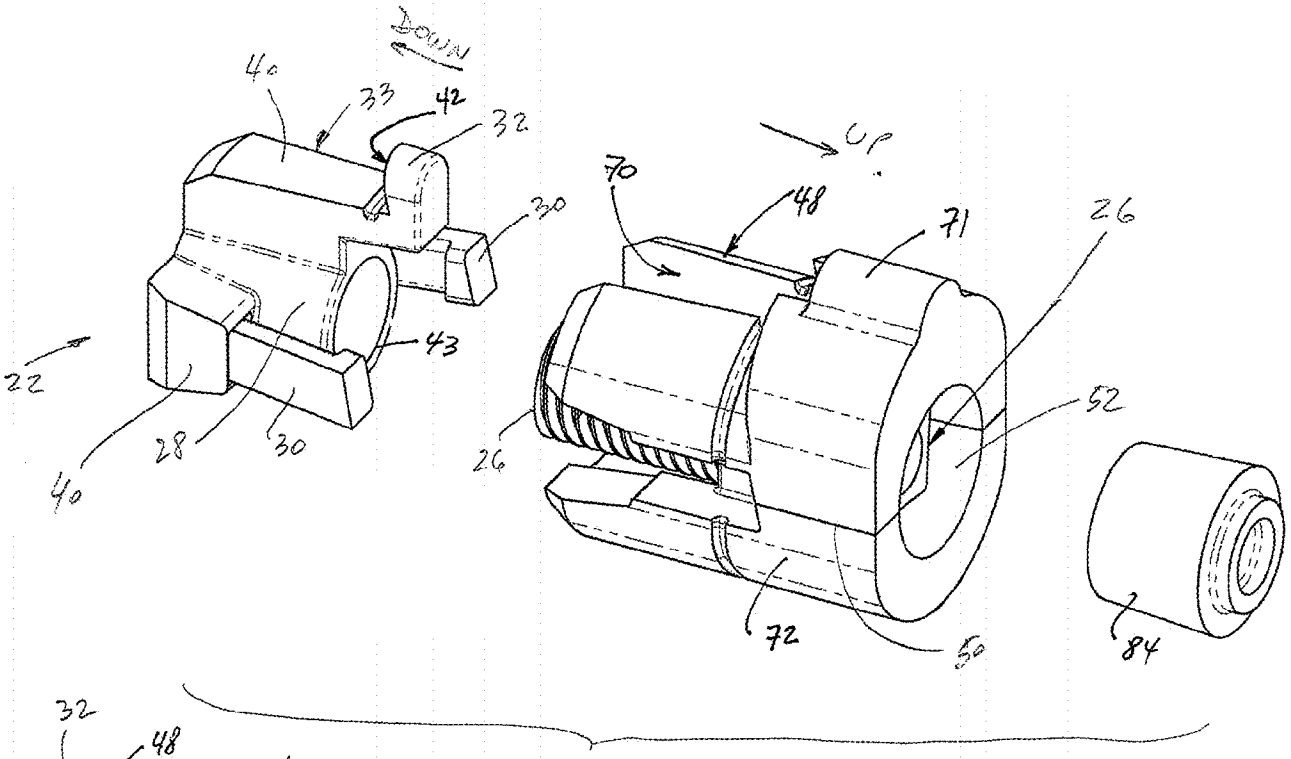
FIG. 7 is an exploded view of the connector pin shown in FIG. 6.
Figure 6:
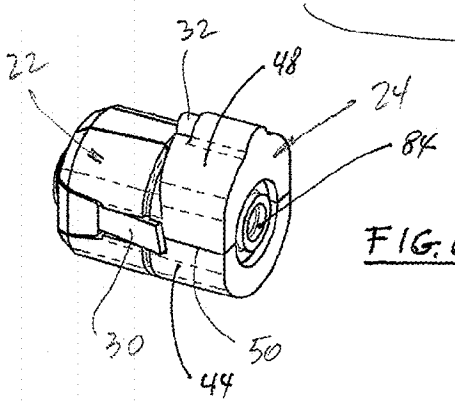
FIG. 6 shows an assembled connector pin constructed according with the invention.
Figure 8:
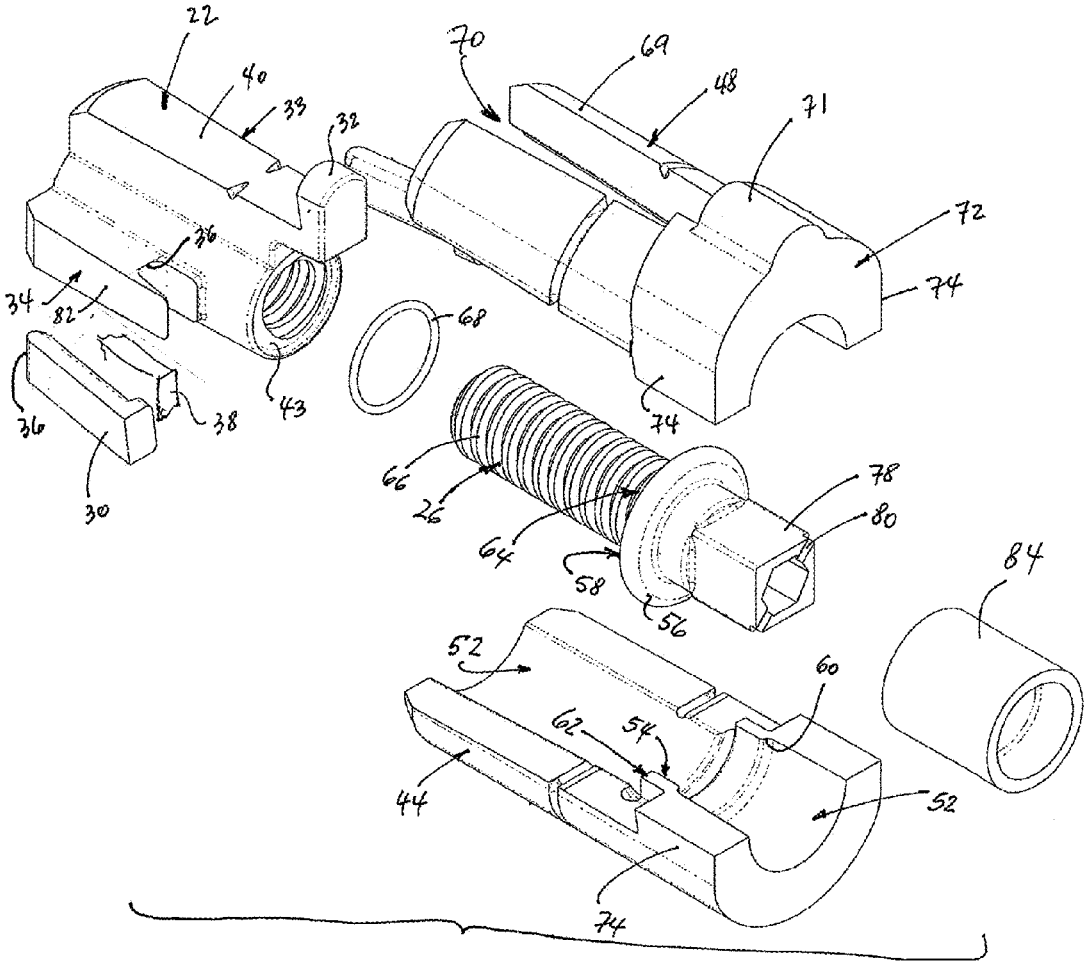
FIG. 8 shows the components of the connector pin shown in FIGS. 6 and 7 separated from each other to better illustrate their individual constructions.

Referring to FIGS. 5-7 and addressing the construction of connector pin 20 in greater detail, its base 22, disposed in lip hole 16, has a generally cylindrical center section 28 with pivotally mounted, laterally projecting locking arms 30 and a stop nose 32 formed by a projection 33 that extends outward and upward from the center section and is located circumferentially midway between the locking arms. A curved outer surface 40 of the projection has a diameter that corresponds to the diameter of hole 16 in the lip and permits snug movements of the base in the hole.

Diametrically opposite pivot pockets 34 at the lower end of the center section each have an upwardly open recess which forms cooperating pivot surfaces 36 at the lower ends of the locking arms and their opposing interior pivot pocket surfaces. A resilient member 38, such as a spring or a compressible foam pad, for example, is placed between the inside of the locking arms and the center section and resiliently urges the upper ends of the arms outwardly.

Figure 2:
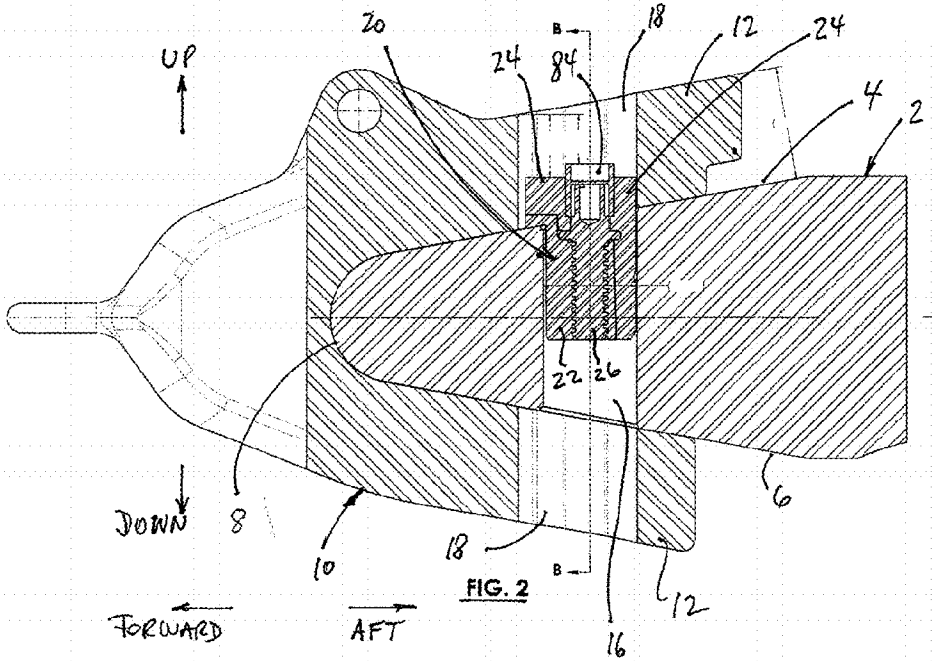
FIG. 2 is a cross-section taken along line A-A of FIG. 1, and shows the shroud in its installed condition securing the shroud to the lip.

Stop nose 32 at the upper end of projection 33 is located inside shroud bore 18. An underside 42 of the stop nose faces downwardly and is dimensioned so that when it engages upper lip surface 4 as best seen in FIG. 2 the upper end 43 of the center section is positioned slightly below the upper lip surface.

Housing 24 is longitudinally split along a vertical parting line 50 into first and second housing halves 44, 48 which leaves the earlier mentioned small gaps between opposing surfaces of the halves. Together the two halves form a tubular structure which, on its outside, movably engages both lip hole 16 and shroud hole 18 and is slidable along them. On the inside of the housing is threaded bolt 26. The bolt is placed inside one of the housing halves and thereafter the halves are placed over each other and over the bolt in a cavity between them. When assembled the cavity inside the housing forms the insides of both housing halves form an upper aperture section 52, where bolt head 78 is located, an intermediate, reduced diameter middle aperture section 54, which houses a section of the shaft between the bolt head and the upper end of the threads on the shaft, and a lower aperture section 55 which surrounds the base. The thickness of the middle aperture section is selected so that the lower end 62 of the intermediate aperture section 54 engages the upper end 43 of the center section when bolt 26 is tightened and the free ends of the locking arms 30 are moved into contact with engagement ledges 86 formed by the shroud legs as further described below.

The bolt has a ring flange 56 at the lower end of the head the underside 58 of which rests on a ring-shaped ledge formed by the upper end 60 of middle aperture section 54. The bolt further has a groove 64 between the underside 58 of ring flange 56 and the beginning of threads 66 on the shaft of the bolt. The groove is sufficiently wide to accommodate and straddle middle aperture section 54 and allows the bolt rotate in the cavity of the housing.

Figure 3:
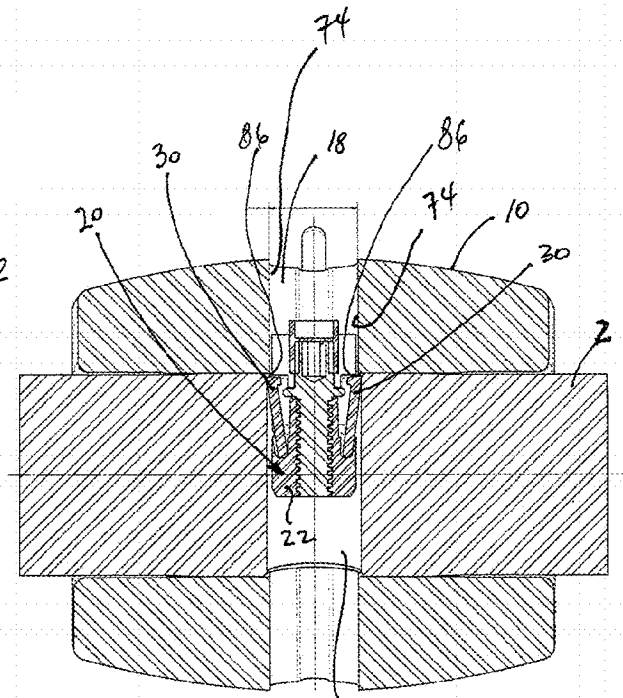
FIG. 3 is a cross-section taken along line B-B of FIG. 2 and also shows the shroud in its installed condition.
Figure 4:
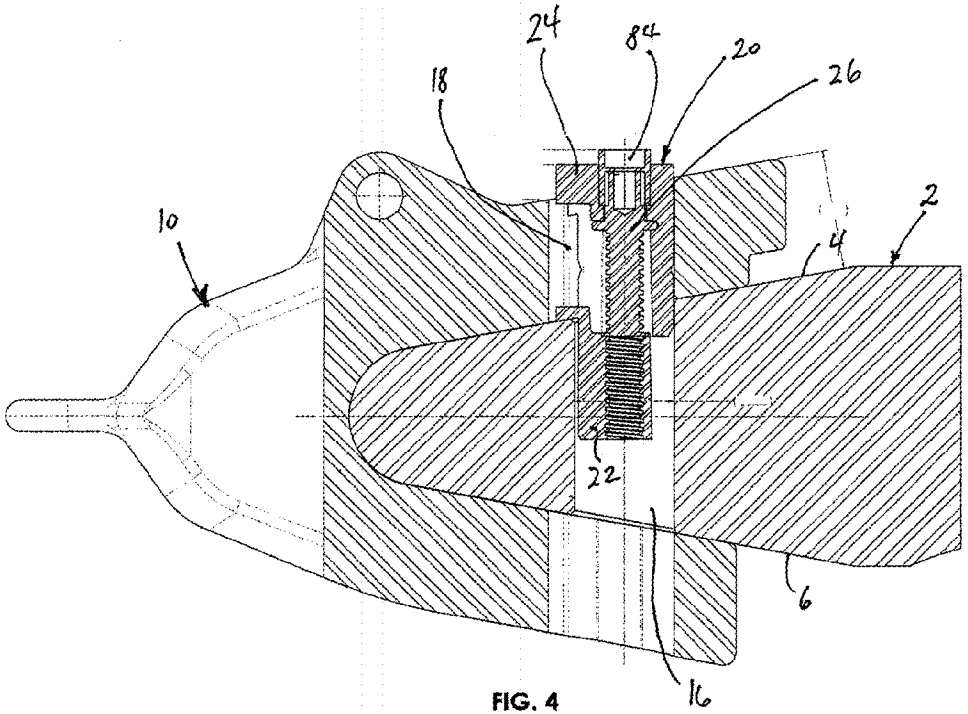

The connector pin is assembled prior to its installation and use by separating the housing halves 44, 48 and initially placing a bolt 26 in one of them so that its ring flange 56 rests on the upper end 60 of middle aperture section 54 and its groove 64 straddles the middle aperture section. The other housing half is then placed over the bolt and the bolt is threaded into the center section. This moves the housing halves 44, 48 and the base from the initial assembly position, as generally illustrated in FIGS. 4 and 5, into the fully assembled position, as illustrated in FIGS. 2 and 3. A gasket, such as an O-ring 68 is placed between the underside 58 of ring flange 56 on the bolt and upper end 43 of center section 28 to shield the threads from contamination during use.

First housing half 44 extends over substantially the full length of the connector pin. Its exterior is semi-circular and conforms to the diameter of hole 16 and the shape of bore 18 in the shroud leg so that the housing is axially slidable in the hole.

Second housing half 48 has the same axial length as the first housing. A lower part 69 of this housing has the same diameter as the exterior of the first housing and includes an axially extending, elongated cut-out 70 that is dimensioned to accommodate projection 33 extending upwardly from the center section 28 of the base and positioned midway between the respective locking arms 30

An upper part 72 of the second housing half 48 has an enlarged cross-section relative to the diameter of lip hole 16 in the lip that is oblong and forms opposing, parallel, flat surfaces 74 which are spaced apart by less than the diameter of hole 16. As a result portions of the shroud leg 12 overly hole 16 in the lip and form a pair of opposite, downwardly facing engagement ledges 86. The upper part of the housing further defines another vertically projection 71 that is aligned with and overlies stop nose 32 at the end of projection 33.

The exterior configuration of bore 18 in shroud leg 12 corresponds to that of the upper housing part 72 so that the housing and therewith the entire connector pin are non-rotatable relative to shroud leg 12. This enables the tightening and loosening of the bolt into and out of the base. On the lower part of the housing corresponding flat surfaces are aligned with flat surfaces 74 on the upper part of the housing. These flat surfaces are formed by outer surfaces of the pivot pockets 34 and by outer surface portions of the lower housing half adjacent the pivot pockets.

To facilitate the assembly of the connector bolt head 78 includes a power-drive coupling, such as a screw driver slot 80, a socket-head 82 or the like for electrically turning the bolt, as with an electric drill.

Prior to its installation, e.g. at the time of its manufacture, bolt 26 of the connector pin is tightened to secure the parts to each other. The connector pin is installed by manually compressing the arms locking arms inwardly so they fit into open bore 18. The connector pin is next dropped or pushed into the bore where it can slide gravitationally downwardly, if needed assisted by manually pushing. Once the biasing force exerted by resilient member 38 has moved the upper ends of the locking arms 30 to beneath engagement ledges 86 overlying hole 16 in the lip, the laterally expanded locking arms lock and fix the connector pin in place on the lip and ready for use. To protect the inside of bore 18 from contaminants a cap 84, preferably made of a resiliently deformable material such as rubber or plastic, is placed into the bore and over bolt head 78 in the bore after the installation is complete.

To replace a worn shroud, cap 84 is first removed and connector pin 20 is disassembled while in place inside hole 16 and bore 18 by backing up bolt 26, preferable with an electric drive to save time and shatter any compacted solid material that may have accumulated in the bore during use. The unthreaded bolt and the housing halves 44, 48 are then slidably removed from the bore and base 22 is slidably removed from the hole.

Figure 9:
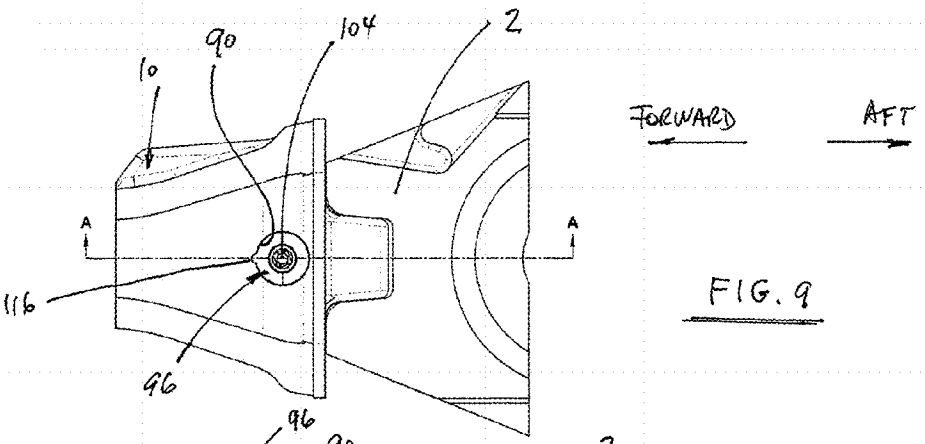
FIG. 9 is a plan view similar to FIG. 1 and shows another embodiment of a connector pin constructed according to the invention.
Figure 10:
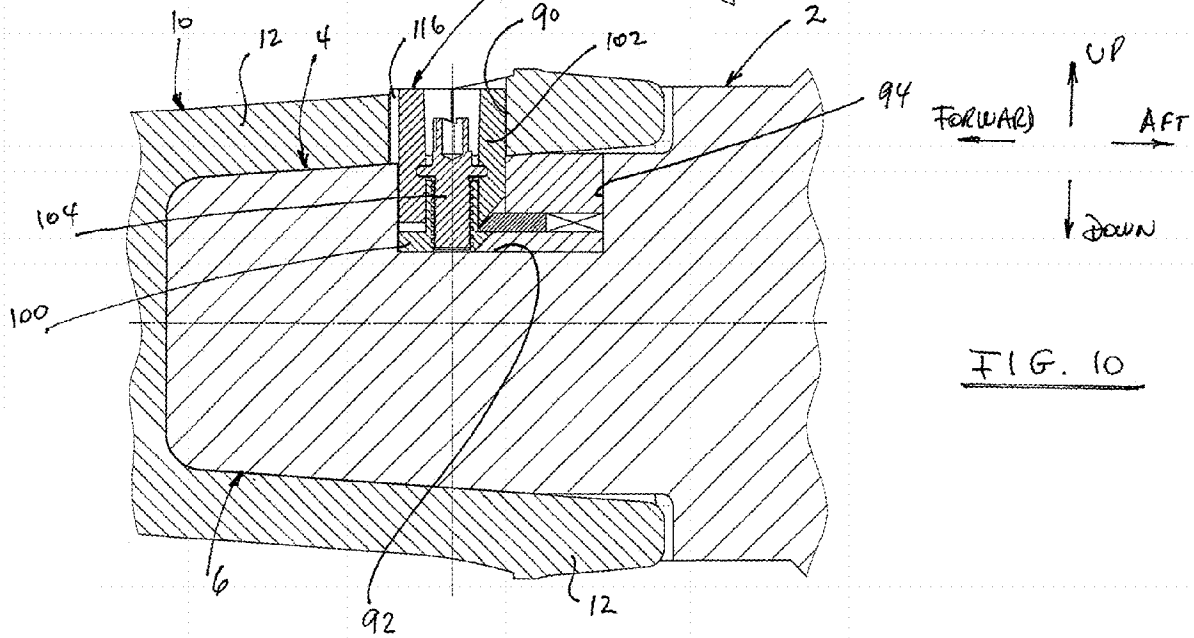
FIG. 10 is an upright cross-section taken along line A-A of FIG. 9.
Figure 11:
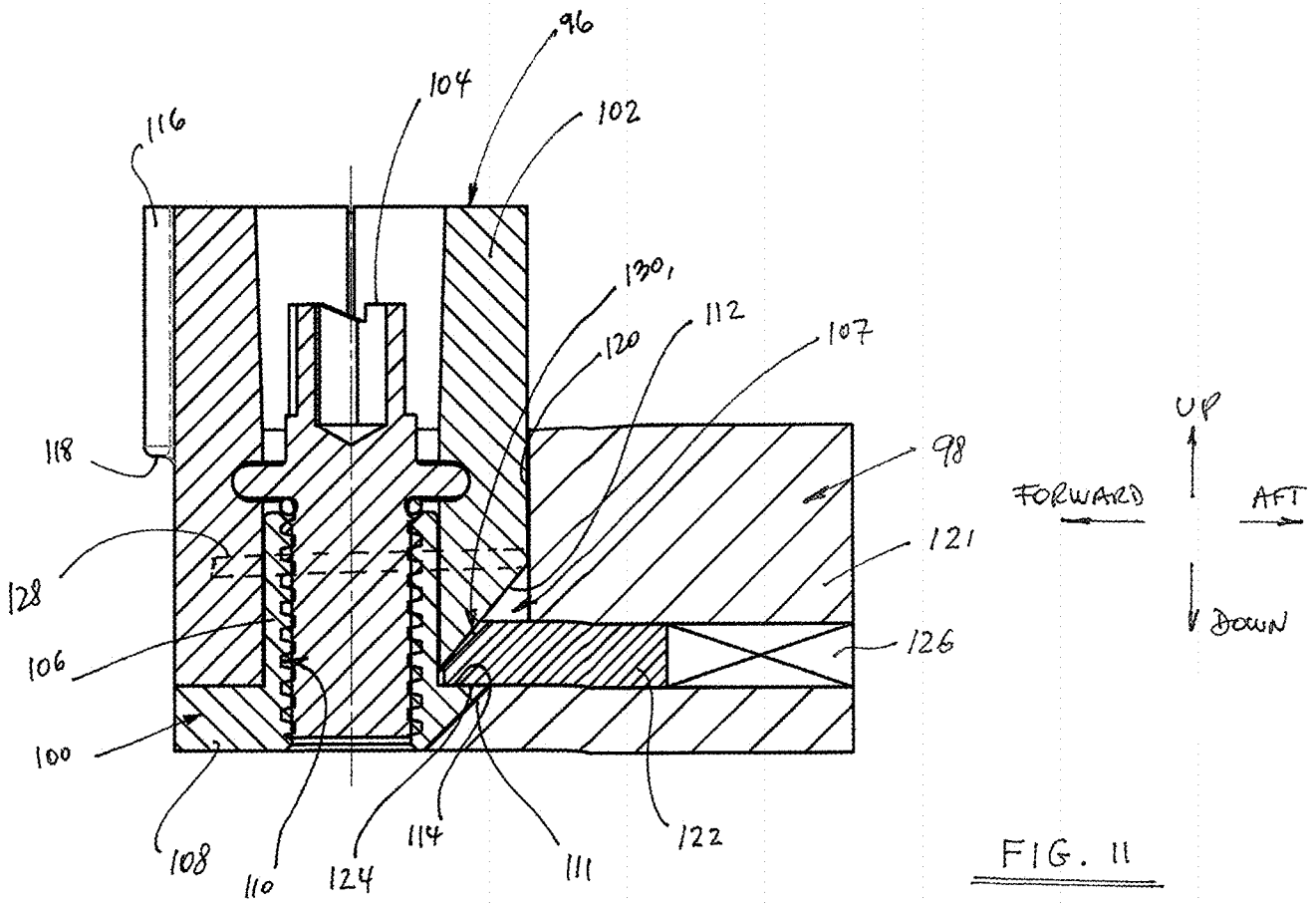
FIG. 11 is an enlarged cross-sectional view of the connector pin shown in FIG. 10.

FIGS. 9-11 illustrate another embodiment of the invention for securing a shroud 10 to a lip 2 of a bucket. Legs 12 of the shroud engage upwardly and downwardly facing surfaces 4, 6 of the lip as was previously described. In this embodiment the upper leg of the shroud has a round through bore 90 which communicates with an upwardly open depression 92 in upper surface 4 of the lip. The depression includes an upwardly open chamber 94 that extends laterally away from bore 90 in the leg. A connector pin 96 extends from bore 90 into the portion of depression 92 disposed directly beneath the bore. A connector pin locking device 98 is located in chamber 94.

Similar to connector pin 20 shown and described earlier, connector pin 96 has a base 100, a housing 102 partially surrounding the base, and a threaded bolt 104 which releasably secures the housing to the base.

Base 100 includes a cylindrical center section 106 with a threaded, upwardly open hole, and an enlarged diameter lower end 108. Along a portion of one side, e.g. its aft side as seen in FIG. 10, lower end 108 has a downwardly facing, upwardly diverging first contact surface 111 that intersects a horizontally oriented locking surface 114 formed in turn by a recess 107 on the exterior of the housing. A second, upwardly diverging contact surface 112 extends from the locking surface upwardly at an inclined angle as is illustrated in FIGS. 10 and 11.

Housing 102, like the housing of connector pin 20 described above, is longitudinally split into two housing halves. Its exterior is cylindrical and shaped so that it can be slidably inserted into and withdrawn from bore 90 in shroud leg 12 and depression 92 in lip 2. Schematically illustrated dowel pins 128 extend across the opposing surfaces of the halves and align them in the vertical direction.

To assure proper rotational alignment of the locking surface 114 with locking device 98, the housing and the base are rotationally fixed relative to each other, for example by providing a cooperating radially oriented groove and a groove-engaging projection interlock (not shown) between opposing, surfaces of the base and the housing.

To prevent rotation of housing 102 relative to lip bore 90 and fix the orientation of the connector pin 96 in the bore, the upper part of the housing includes a laterally projecting, vertically oriented projection 116. The lower end 118 of the projection engages upper lip surface 4 which limits the downward movement of the connector pin. The position of projection 116 is selected so that when it engages its mating vertically oriented groove (not separately shown) in bore 90, the recess 107 and contact surfaces 111, 112 face towards aft chamber 94.

Locking device 98 has a body 121 that snugly but slidably fits into recess chamber 94. A forward side 120 of the body snugly but slidably faces the outside of connector pin 9 over an arc of less than 180 degrees and helps stabilize the fully inserted connector pin. A locking pawl 122 is slidably arranged in a forwardly open passage in body 121 and includes an engagement surface 124 which, in use, overlaps locking surface 114 on base 100 and thereby restrains the connector pin to lip 2. An actuator 126, such as a resilient foam pad, or magnetic, electric, hydraulic or pneumatic device, for example, resiliently urge pawl 122 in a forward direction toward the housing so that the underside 124 of the pawl contacts locking surface 114.

Connector pin 96 is installed by first assembling its parts and tightening bolt 104 to secure all components of the connector pin to each other. Locking device 98 is placed into recess chamber 94 so that its pawl 122 extends into the portion of depression 92 which overlies bore 90 in leg 12. Projection 116 of the connector pin is aligned with its associated groove and inserted into the bore. As the connector moves downwardly lower contact surface 111 of base 100 engages the upwardly inclined nose end 130 of the pawl and pushes the pawl out of the downward path of the connector pin so that it can be fully inserted into the depression.

After engagement surface 124 of the pawl has moved past locking surface 114 on base 100, actuator 126 pushes the pawl into space 107 above locking surface. This locks the base and therewith the housing and entire connector pins to lip 2. The connector pin remains fixed relative to the lip because the overlying shroud leg does not permit the locking device to move out of its chamber.

The connector pin is removed in essentially the same manner in which connector 20 is removed as earlier described, i.e. by first unthreading bolt 104 and then, following the removal of the shroud from the lip, manually withdrawing all parts of the connector and locking device from lip bore 90 an depression 92.

Other variations are within the spirit and scope of the present invention. Thus, while the invention is susceptible to various modifications and alternative constructions, certain illustrated embodiments thereof are shown in the drawings and have been described above in detail. It should be understood, however, that there is no intention to limit the invention to the specific form or forms disclosed, but on the contrary, the intention is to cover all modifications, alternative constructions, and equivalents falling within the spirit and scope of the invention, as defined in the appended claims.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of installing and removing consumable digging components having a shroud with spaced-apart legs that overlie and contact a lip of a ground handling container, the lip having a hole and a first leg of the spaced-apart legs having an oblong-bore aligned with the hole, and the first leg having axially extending spaced-apart walls which define engagement ledges that overlap the hole, the method comprising:

providing a connector for placement inside the hole and the oblong-bore, the connector having shaped surfaces on an exterior of the connector for positioning between the walls so that the connector is axially movable along the walls and past the engagement ledges, constructing the connector with a base for insertion into the hole and with a housing for partial placement in the hole and the oblong-bore, the housing being axially split apart to define opposing housing shells, and fixing the housing and the base against relative rotational movements, wherein the housing comprises a first projection configured to be positioned inside the oblong-bore laterally past the hole to limit how far the housing can move axially into the hole, wherein the connector further comprises retractably positionable locking arms extendable from surfaces of the base which face the walls and resiliently urge ends of the arms facing the hole in a laterally outward direction towards the walls, and wherein the base comprises a second projection in lateral alignment with the first projection and configured to be positioned into a space between the first projection and the lip, axially moving the connector, base-first, into the hole and the oblong bore by retracting the locking arms laterally inwardly as the connector is moved into the oblong-bore, and expanding ends of the arms laterally outwardly after their ends have passed the engagement ledges to thereby lock the base and the housing to the first leg of the consumable component and the lip.

2. A method according to claim 1, including maintaining an axially oriented gap between opposing surfaces of the housing shells.

3. A method according to claim 1, including filling the gap with granular material that becomes compacted in the gaps and further rigidifies the connector.

4. A method according to claim 1, including removing the consumable component from the lip by, moving the housing and the lip axially apart by separating the housing from the base, and respectively sliding the housing and the base out of the hole and the bore.

5. A method according to claim 1, wherein axially moving comprises connecting the housing and the base with a bolt threadably engaging the base, and turning the bolt to move the housing and the base away from each other to thereby release the consumable component from the lip by unthreading the bolt from the base and thereafter axially withdrawing the bolt and the housing from the bore.

6. A method according to claim 5, wherein turning comprises attaching a rotary power drive to the bolt while the bolt is disposed inside the housing, and activating the power drive.

7. A method according to claim 6, including applying the rotary power drive against hardened debris surrounding the bolt to shatter the debris before turning the bolt.

8. A method according to claim 5, wherein the base has an effective diameter that is less than a diameter of the hole, and wherein sliding the base comprises pushing the base out of the hole.

9. A releasable connection comprising:

a lip, of a container of ground handling equipment, comprising spaced apart upper and lower exterior lip surfaces, and a hole extending between the upper and lower exterior lip surfaces;

a shroud, of a consumable digging component, having spaced-apart legs in contact with the upper and lower lip surfaces, and an oblong bore extending through a first leg of the spaced-apart legs, wherein the hole and the oblong bore are aligned to overlap and define engagement ledges comprising portions of the first leg overlapping the hole;

a connector positioned within the hole and oblong bore and configured to removably secure the shroud to the lip, the connector comprising a base disposed in the hole, a housing disposed in the hole and the oblong bore, and a bolt threadably engaging the base, arranged inside a cavity in the housing, wherein the connector is further configured to be engageable and removable from the hole and oblong bore by turning the bolt relative to the base in the lip aperture, the bolt securing the housing to the base when it is tightened and disengaging the base and the housing when the bolt is unthreaded, and a locking device, arranged in the hole, of the base including a locking member movable relative to the base and having a locking surface arrange to engage against the engagement ledge and operative to prevent removal of the base from the hole in the lip while the shroud legs are in contact with the lip surfaces.

10. The releaseable connection of claim 9, wherein the housing is axially split apart to define opposing housing shells.

11. The releaseable connection of claim 9, wherein the base comprises a stop nose for limiting depth of insertion of the base into the hole.

12. The releasable connection of claim 9, wherein the locking device comprises a plurality of locking arms.

13. The releasable connection of claim 9, wherein the base comprises a projection that is configured to cooperatively engage with an elongated cut-out of the housing.

14. The releasable connection of claim 13, wherein the projection has a curved outer surface that has a diameter that corresponds to a diameter of the hole in the lip and permits movement of the base in the hole.

15. The releasable connection of claim 9, further comprising a cap made of a resiliently deformable material that is placed into the housing to cover a head of the bolt.

* * * * *